US011254533B2

(12) United States Patent
Gabler

(10) Patent No.: US 11,254,533 B2
(45) Date of Patent: Feb. 22, 2022

(54) DEVICE AND METHOD FOR WINDING UP A FILM AT A PACKAGING MACHINE

(71) Applicant: Multivac Sepp Haggenmüller SE & Co. KG, Wolfertschwenden (DE)

(72) Inventor: Albert Gabler, Lachen-Albishofen (DE)

(73) Assignee: MULTI VAC SEPP HAGGENMUELLER SE & CO. KG, Wolfertschwenden (DE)

( * ) Notice: Subject to any disclaimer, the term of this patent is extended or adjusted under 35 U.S.C. 154(b) by 124 days.

(21) Appl. No.: 15/929,380

(22) Filed: Apr. 29, 2020

(65) Prior Publication Data

US 2020/0346884 A1 Nov. 5, 2020

(30) Foreign Application Priority Data

Apr. 30, 2019 (DE) ..... 10 2019 206 153.2

(51) Int. Cl.
*B65H 75/22* (2006.01)
*B65H 18/08* (2006.01)
*B65H 18/02* (2006.01)

(52) U.S. Cl.
CPC ..... *B65H 18/08* (2013.01); *B65H 18/026* (2013.01); *B65H 2405/421* (2013.01)

(58) Field of Classification Search
CPC ..... B65H 18/08; B65H 18/026; B65H 75/10; B65H 75/22; B65H 75/2209; B65H 75/2218; B65H 75/2236
See application file for complete search history.

(56) References Cited

U.S. PATENT DOCUMENTS 1,832,590 A 11/1931 Sponable et al.
2,585,159 A 2/1952 Morley
(Continued)

FOREIGN PATENT DOCUMENTS

AU 778927 B2 12/2004
AU 780665 B2 4/2005
(Continued)

OTHER PUBLICATIONS

European Search Report Application No. 20160698.5 dated Sep. 8, 2020.
(Continued)

*Primary Examiner* — Sang K Kim
(74) *Attorney, Agent, or Firm* — Brooks Kushman P.C.

(57) ABSTRACT

A device for winding up a film at a packaging machine, the device including a reception mandrel drivable for rotation about a rotation axis and a reception sleeve for the film for being pushed onto the reception mandrel. The reception sleeve may be formed by segments arranged next to each other along a circumference or perimeter of the reception sleeve, wherein neighboring or adjacent segments may be pivotably connected to each other. The reception mandrel may be formed as rigid body having engagement structures that are configured to cooperate with shape features of an inner circumference or perimeter of the reception sleeve, when the reception sleeve has been pushed onto the reception mandrel, so that a rotation of the reception mandrel about the rotation axis causes the reception sleeve to rotate with the reception mandrel.

17 Claims, 6 Drawing Sheets

(56) References Cited

U.S. PATENT DOCUMENTS

| | | | | |
|---|---|---|---|---|
| 2,973,160 | A * | 2/1961 | Zernov | B65H 75/242 242/575.5 |
| 3,355,121 | A | 11/1967 | Wright | |
| 3,396,918 | A * | 8/1968 | Adamson | B65H 75/10 242/570 |
| 8,029,201 | B2 | 10/2011 | Chen | |
| 2004/0113011 | A1* | 6/2004 | Place | B65H 75/22 242/609.1 |
| 2004/0262446 | A1* | 12/2004 | Place | B65H 75/10 242/613 |
| 2005/0145746 | A1* | 7/2005 | Place | B65H 75/22 242/577 |
| 2017/0253459 | A1* | 9/2017 | Gabler | B65H 18/08 |
| 2018/0222713 | A1* | 8/2018 | Toye | B65H 75/30 |

FOREIGN PATENT DOCUMENTS

| | | | |
|---|---|---|---|
| EP | 3214031 | A1 | 9/2017 |
| GB | 2386366 | A | 9/2003 |

OTHER PUBLICATIONS

European Search Report dated Sep. 8, 2020, Application No. 20160698.5-1017—Applicant MULTIVAC Sepp Haggenmueller SE & Co. KG, 8 Pages.

* cited by examiner

DEVICE AND METHOD FOR WINDING UP A FILM AT A PACKAGING MACHINE

CROSS-REFERENCE TO RELATED APPLICATIONS

This application claims priority to German Patent Application No. 10 2019 206 153.2 filed on Apr. 30, 2019 to Albert Gabler, currently pending, the entire disclosure of which is incorporated herein by reference.

FIELD OF THE INVENTION

The invention relates to winding up a film at a packaging machine.

BACKGROUND OF THE INVENTION

In packaging machines, such as tray sealing machines or thermo-forming machines, film webs are processed. For example, packages are closed by sealing attachment of a film supplied as a film web. Of the supplied film web, a residual film mesh may be left over by such process. The residual film mesh may be wound up at a winding device and may afterwards be removed from the packaging machine as a roll. Such winding devices generally comprise a rotatable reception mandrel about which the film is wound. It must generally be ensured that the roll generated through winding can afterwards still be removed from the reception mandrel.

From EP 3 214 031 A1, a device for winding up a film at a packaging machine is known. In that device, the residual film mesh is not directly wound onto the reception mandrel, but a reception sleeve that can be pushed onto the reception mandrel is provided to receive the film. The reception sleeve comprises link elements that are connected to each other by hinges arranged in parallel to a central axis of the reception sleeve. The reception mandrel comprises tensioners in the form of paddles which can be adjusted in a radial extension of the reception mandrel so as to allow tensioning the reception sleeve in a torque-proof manner. Due to the torque-proof tensioning, the reception sleeve will rotate together with the reception mandrel and the residual film mesh can be wound up. If the wound roll is to be removed later, the tensioners of the reception mandrel are radially pivoted towards an inside, so that the reception sleeve with the roll wound thereon can be axially withdrawn from the reception mandrel. Afterwards, segments of the reception sleeve can be pivoted inwardly towards the center axis of the reception sleeve due to the hinges, so that the reception sleeve can transition from a substantially cylindrical configuration to a folded and instable configuration, in which the reception sleeve can be taken out of the film roll. The reception sleeve can later be reused for winding another film roll. Providing the reception sleeve facilitates pulling the wound-up film roll from the reception mandrel. Further, the reception sleeve may upon winding of the film receive and/or evenly distribute compression forces and therefore increases stability of the device.

A disadvantage of the known system is the complex structure of the reception mandrel with the tensioners that are adjustable in the radial direction of the reception mandrel for tensioning the reception sleeve in a torque-proof manner. Further, the tensioners may be damaged due to the high compression forces that are particularly present when winding highly elastic films. Also, operation of the device is comparably troublesome, as the tensioners have to be adjusted upon mounting and demounting the reception sleeve on the reception mandrel. Another difficulty is correct adjustment of the tensioners such that, on one hand, torque-proof tensioning of the reception sleeve is ensure and, on the other hand, the forces acting on the tensioners are not too high.

SUMMARY OF THE INVENTION

It is an object of the invention to improve winding up of a film at a packaging machine with respect to ease of operation and reduced maintenance while preferably using simple means.

A device for winding up a film at a packaging machine according to the invention comprises a reception mandrel that is drivable for rotation about a rotation axis, and a reception sleeve for the film for being pushed onto the reception mandrel. The reception sleeve is formed by segments that are arranged next to each other along a circumference or perimeter of the reception sleeve. Neighboring segments of the reception sleeve are pivotally connected with each other. The reception mandrel may be formed as rigid body having engagement structures. The engagement structures are configured to cooperate with shape features of an inner circumference or perimeter of the reception sleeve, when the reception sleeve has been pushed onto the reception mandrel, such that rotation of the reception mandrel about the rotation axis of the reception mandrel causes the reception sleeve to co-rotate. Therefore, the film, in particular a residual film mesh, can be wound up on the reception sleeve pushed onto the reception mandrel upon rotation of the reception mandrel. The wound-up film roll can be removed by pulling the reception sleeve from the reception mandrel. Forming the reception sleeve from segments that are pivotally connected to each other facilitates removing the reception sleeve from the inner circumference or perimeter of the film roll after pulling the reception sleeve from the reception mandrel.

Cooperation of the engagement structures of the reception mandrel with the shape features of the inner circumference or perimeter of the reception sleeve allows providing a rotation-proof connection between the reception sleeve and reception mandrel without providing movable tensioners, so that the reception sleeve may be co-rotated upon rotation of the reception mandrel. By forming the reception mandrel with the engagement structures as a rigid body, the device may be particularly stable and may without difficulty withstand high compression forces present when winding up highly elastic films. The engagement surfaces rigidly formed at the reception mandrel ensure in a simple manner and without additional measures by a user that the reception sleeve rotates together with the reception mandrel.

Preferably, in a pushed-on state of the reception sleeve, neighboring or adjacent segments of the reception sleeve are connected to be pivotable about pivoting axes that extend parallel to the rotation axis of the reception mandrel. This allows to bring the reception sleeve in an instable configuration after pulling the reception sleeve from the reception mandrel by pivoting segments of the reception sleeve towards an inside of the reception sleeve. In the instable configuration, the reception sleeve may be folded and can be removed from the inside of the wound-up roll.

To achieve particularly good transmission of force between the reception mandrel and the reception sleeve, the engagement structures of the reception mandrel may extend in parallel to the rotation axis of the reception mandrel.

Preferably, the engagement structures are symmetrically distributed along the circumference or perimeter of the reception mandrel. This ensures homogeneous transmission of force between the reception sleeve and the reception mandrel and further enables slipping the reception sleeve onto the reception mandrel in different rotational orientations.

If at least four engagement structures are provided along the circumference or perimeter of the reception mandrel, particularly good and homogenously distributed transmission of force between the reception sleeve and the reception mandrel may be achieved.

Preferably, the number of engagement structures corresponds to the number of segments of the reception sleeve. This enables the segments of the reception sleeve to adjust particularly well to the shape of the reception mandrel by pivoting with respect to neighboring/adjacent segments.

The engagement structures may, for example, be formed as projections and/or ribs of the reception mandrel. Such structures are easy to manufacture and well-suited for cooperating with shape features of the inner circumference or perimeter of the reception sleeve.

The engagement structures of the reception mandrel and the shape features of the inner circumference or perimeter of the reception sleeve may comprise shapes that correspond to each other. In particular, the engagement structures and the shape features may have complimentary shapes. This allows good transmission of force. However, it may be indeed possible that in a state in which the reception sleeve is mounted on the reception mandrel, there may be play between the engagement structures of the reception mandrel and the shape features of the inner circumference or perimeter of the reception sleeve to facilitate mounting and demounting of the reception sleeve.

According to a simple embodiment, the shape features of the inner circumference or perimeter of the reception sleeve which cooperate with the engagement structures of the reception mandrel may be defined by the mutual arrangement of the segments of the reception sleeve. For example, neighboring segments of the reception sleeve may be arranged at a particular angle with respect to each other in a mounted state of the reception sleeve. Said angle may define a shape feature of the inner circumference or perimeter of the reception sleeve that engages with an engagement structure of the reception mandrel. As an alternative or additionally, the engagement structures of the reception mandrel may also be defined through the shape of the individual segments of the reception sleeve. For example, the segments of the reception sleeve may, at their side that faces towards an inside of the reception sleeve, comprise a specific surface profile that may be engaged by the engagement structures.

Preferably, a retainer configured to secure an axial position of the reception sleeve on the reception mandrel may be provided. This may prevent dissociation of the reception sleeve from the reception mandrel upon rotation of the reception mandrel.

The retainer may, for example, be an elastic element provided on the reception mandrel. Such elastic element might, for example, be an O-ring, a silicone ring or a spring ring. In a mounted state of the reception sleeve, the elastic element might be provided between an outer circumference or perimeter of the reception mandrel and the inner circumference or perimeter of the reception sleeve. The elastic element may provide a holding force acting against an axial movement of the reception sleeve on the reception mandrel. The holding force may be preferably selected such that the reception sleeve will not dissociate by itself during operation, but removal of the reception sleeve (in particular together with the film wound-up thereon) by a user is still possible. As an alternative or additionally, the retainer may comprise a wedge system. The wedge system may, for example, comprise one or more wedges that may at least partially be pushed between the reception mandrel and the reception sleeve mounted thereon and therefore secure the reception sleeve along an axial direction.

The invention also comprises a method for winding up a film at a packaging machine. The device according to the invention is suitable, designed and configured for carrying out the method. Features described in relation to the device may be transferred to the method and vice versa.

A method for winding up a film at a packaging machine according to the invention comprises pushing a reception sleeve onto a reception mandrel that may be formed as rigid body having engagement structures. The reception sleeve may be formed by segments arranged next to each other along a circumference or perimeter of the reception sleeve, wherein neighboring segments are pivotally connected to each other. The reception mandrel may be driven for rotation about a rotation axis. Thereby, the engagement structures of the reception mandrel cooperate with shape features of an inner circumference or perimeter of the reception sleeve mounted on the reception mandrel such that the rotation of the reception mandrel about the rotation axis causes the reception sleeve to co-rotate, wherein the film may be wound on the reception sleeve.

Preferably, the method also comprises securing an axial position of the reception sleeve on the reception mandrel with a retainer. The retainer may, for example, comprise an elastic element, in particular an O-ring, a silicone ring or a spring ring, provided on the reception mandrel. As an alternative or additionally, the retainer may comprise a wedge system.

The reception sleeve with the wound-up film may be pulled off the reception mandrel. By changing the mutual position of the segments of the reception mandrel by pivoting neighboring segments, a configuration of the reception sleeve may then be changed such that the reception sleeve can be removed from within the wound film roll. Additional features of the method result from the above description of the device.

Other aspects and advantages of the present invention will be apparent from the following detailed description of the preferred embodiments and the accompanying drawing figures.

DESCRIPTION OF THE SEVERAL VIEWS OF THE DRAWINGS

In the following, an advantageous embodiment of the present invention will be explained in more detail making reference to a drawing, in which the individual figures show.

DETAILED DESCRIPTION OF THE INVENTION

Figure 1:
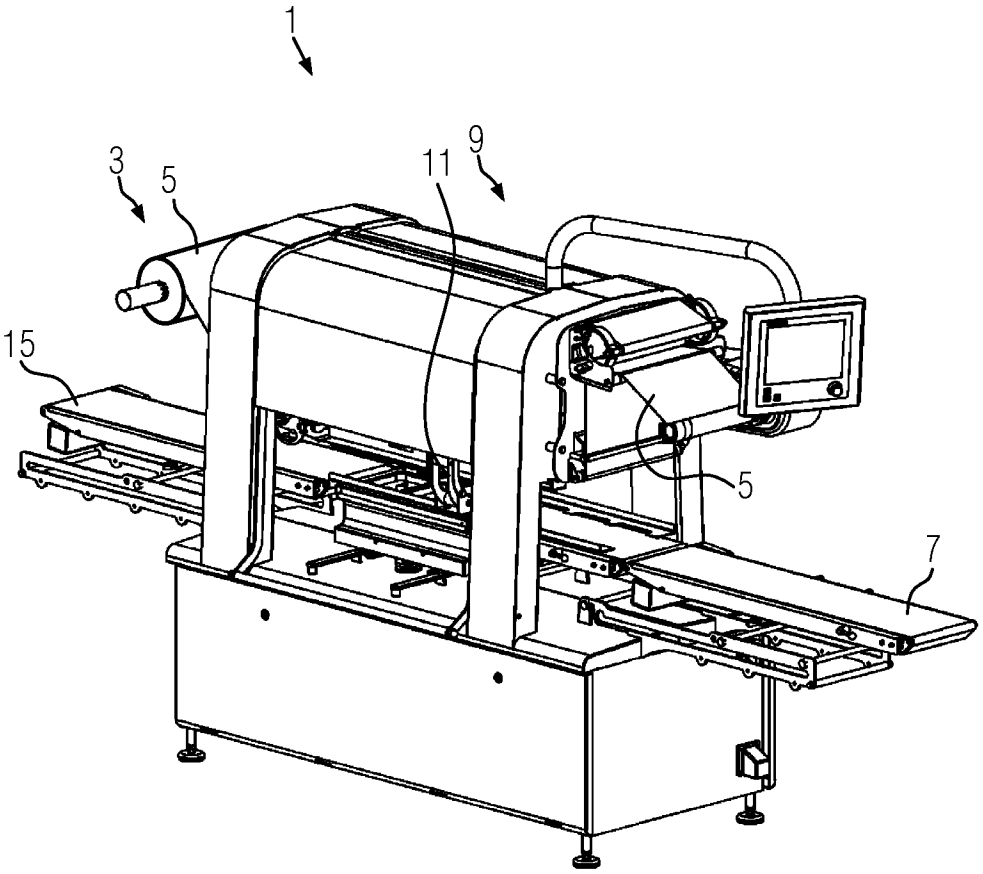
FIG. 1 is a schematic perspective view of one embodiment of a packaging machine with a device for winding up a film in accordance with the teachings of the present disclosure.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows an example of a packaging machine 1 having a device 3 for winding up a film 5 according to the invention. In the illustrated embodiment, the packaging machine 1 is shown as a tray sealing machine. The packaging machine 1 comprises a supply belt 7 conveying filled trays to a sealing station 9. The trays are transferred into the sealing station 9 by a gripper assembly 11. In the sealing station 9, the trays are closed with an upper film 5 (film) by sealingly attaching the upper film 5. The completed packagings are transferred from the sealing station 9 to a removable belt 15 by the gripper system 11.

After sealingly attaching the upper film 5, portions of the upper film 5 that correspond to the packagings or groups of packagings are cut out of the web of the upper film 5 in the sealing station 9. A residual film mesh of the upper film 5 remains and is wound up by the device 3 for winding up the film 5.

Figure 2:
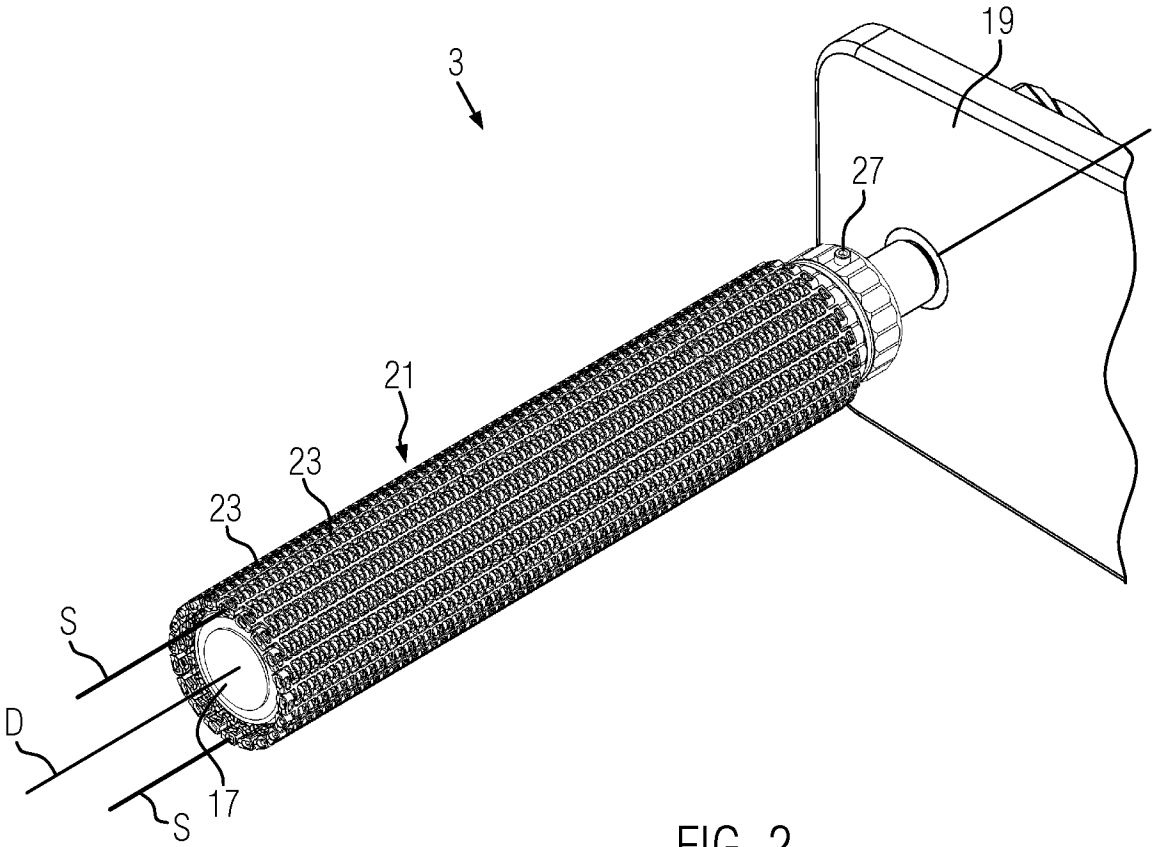
FIG. 2 is a schematic perspective view of one embodiment of a device for winding up a film with a mounted reception sleeve in accordance with the teachings of the present disclosure.

FIG. 2 shows a schematic view of the device 3 for winding up the film 5. The device 3 comprises a reception mandrel 17 that is rotatable about a rotation axis D by a drive assembly 19. A reception sleeve 21 is mounted on the reception mandrel 17. The reception sleeve 21 rotates together with the reception mandrel 17, wherein the film 5 is wound up on the reception sleeve 21. The reception sleeve 21 comprises a plurality of segments 23 that extend in parallel to the rotation axis D. Neighboring segments 23 are pivotally connected to each other, wherein the corresponding pivoting axes S also extend in parallel to the rotation axis D of the reception mandrel 17.

Figure 3:
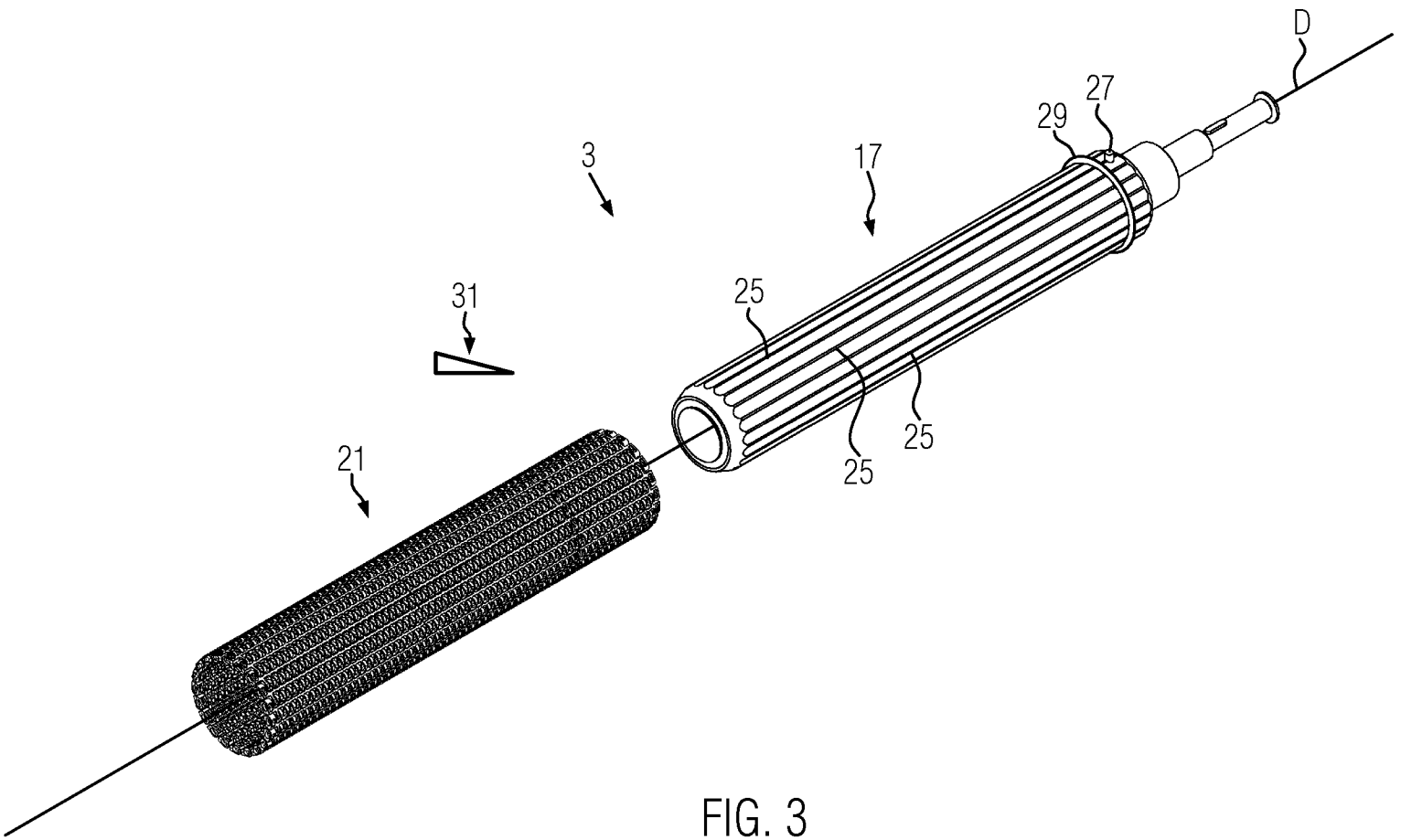
FIG. 3 is a schematic perspective view of one embodiment of a device for winding up a film with the reception sleeve removed in accordance with the teachings of the present disclosure.

FIG. 3 shows a view of the device 3 for winding up the film 5 in which the reception sleeve 21 has been pulled off the reception mandrel 17. The reception mandrel 17 is formed as rigid body comprising engagement structures 25. In the illustrated embodiment, the essentially cylindrical reception mandrel 17 comprises grooves that extend in parallel to the rotation axis D of the reception mandrel 17 and between which rib-like raised structures defining the engagement structures 25 are defined. The reception sleeve 21 may be pushed onto the reception mandrel 17 in parallel to the rotation axis D of the reception mandrel 17. In the illustrated embodiment, a stop 27 (for example in the form of a stud screw) is provided at the reception mandrel 17 to define a possible end position of the reception sleeve 21 when pushing the reception sleeve 21 onto the reception mandrel 17.

To hold the reception sleeve 21 on the reception mandrel 17 after mounting, a retainer may be provided, the retainer comprises an elastic element 29 that has a ring shape and extends about the outer circumference or perimeter of the reception mandrel 17. The elastic element 29 can, in particular, be received in a groove of the reception mandrel 17. When the reception sleeve 21 is mounted, the elastic element 29 lies between an outer circumference or perimeter of the reception mandrel 17 and an inner circumference or perimeter of the reception sleeve 21 and acts against the reception sleeve 21 axially sliding off the reception mandrel 17. As an alternative or additionally, the retainer may also comprise a wedge system 31 that may comprise one or more wedges that may be pushed between the reception mandrel 17 and the reception sleeve 21 after pushing the reception sleeve 21 on the reception mandrel 17 to secure the axial precision of the reception sleeve 21 at the reception mandrel 17.

After the film 5 has been wound up by rotation of the reception mandrel 17 and corresponding co-rotation of the reception sleeve 21 provided thereon, the resulting film roll can be pulled off the reception mandrel 17 together with the reception sleeve 21. For that, the wedge system 31 may first be removed, if applicable. Afterwards, the reception sleeve 21 together with the film roll can be pulled off, if applicable while overcoming a retaining force of the elastic element 29.

Figure 4:
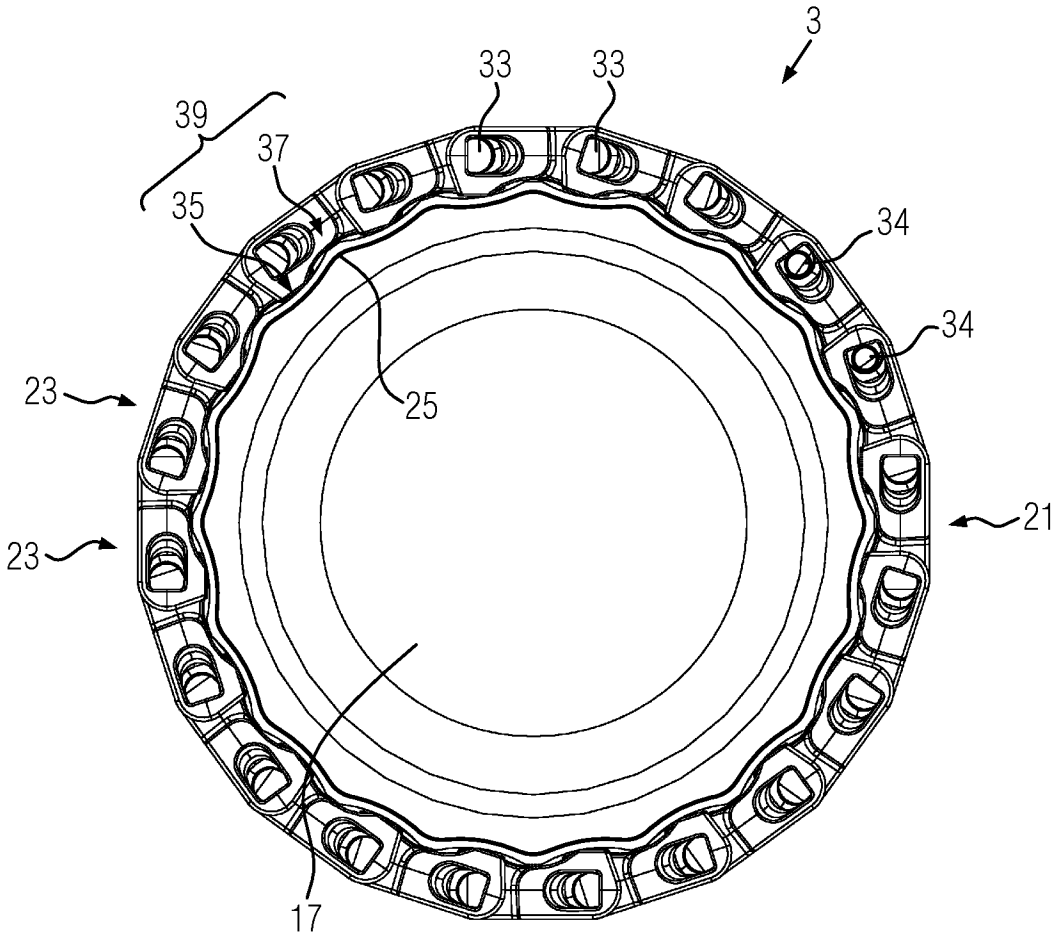
FIG. 4 is a schematic end view of one embodiment of a reception sleeve for a device for winding up a film with the reception sleeve mounted on the reception mandrel in accordance with the teachings of the present disclosure.

FIG. 4 shows the reception mandrel 17 and the mounted reception sleeve 21 in a schematic view with a direction of view along the rotation axis D of the reception mandrel 17. In the illustrated embodiment, the segments 23 of the reception sleeve 21 are provided by link elements that each comprise two reception openings 33 extending in parallel with the rotation axis D. Neighboring segments 23 are nested along a circumference or perimeter of the reception sleeve 21 such that corresponding openings 33 of neighboring segments 23 overlap and provide a common reception opening for bolts or bars 34 (only two illustrated) pivotally connecting neighboring segments 23. In the embodiment illustrated in FIG. 4, the reception sleeve 21 comprises twenty segments 23. Due to the relatively high number of segments 23, the shape of the reception sleeve 21 is relatively well-adjustable to the shape of the reception mandrel 17, which in particular may be a generally cylindrical shape. It would, however, also be conceivable to provide a different number of segments 23.

In the embodiment illustrated in FIG. 4, the side of the segments 23 facing towards an inside are formed such that they each comprise convexities 35 extending towards an inside and portions 37 that extend less towards an inside than the convexities 35. This shape of the individual segments 23 results in an inhomogeneous inner circumference or perimeter of the reception sleeve 21. Due to the shape of the segments 23, shape features 39 of an inner circumference or perimeter of the reception sleeve 21 are formed. The engagement structures 25 of the reception mandrel 17 are provided so as to cooperate with the shape features 39 of the inner circumference or perimeter of the reception sleeve 21 such that rotation of the reception mandrel 17 about the rotation axis D causes co-rotation of the reception sleeve 21. In the illustrated embodiment, the engagement structures 25 of the reception mandrel 17 are provided in the form of ribs extending in parallel to the rotation axis D of the reception mandrel 17. Although not shown in FIG. 4 to scale, it can be recognized that there is certain play between the shape features 39 of the inner circumference or perimeter of the reception sleeve 21 and the engagement structures 25 of the reception mandrel 17, at least before winding up the film 5. This ensures that the reception sleeve 21 may be pushed onto the reception mandrel 17.

Preferably, also the bolts or bars 34 in the openings 33 of the segments 23 of the reception sleeve 21 are provided with play. When the film 5 is wound up through rotation of the reception mandrel 17, a pressure that radially acts from an outside towards an inside acts on the reception sleeve 21, such that the reception sleeve 21 better aligns against the reception mandrel 17 and the engagement structures 25 thereof due to the play of the bolts and bars 35 in the openings 33, such that force transmission between the reception mandrel 17 and the reception sleeve 21 is improved. Due to the pressure acting from outside, the segments 23 mutually stabilize, so that the overall shape of the reception sleeve 21 is stabilized. This ensures that the reception sleeve 21 may be pulled off the reception mandrel 17 in an axial direction, even after winding up the film 5.

Figure 5:
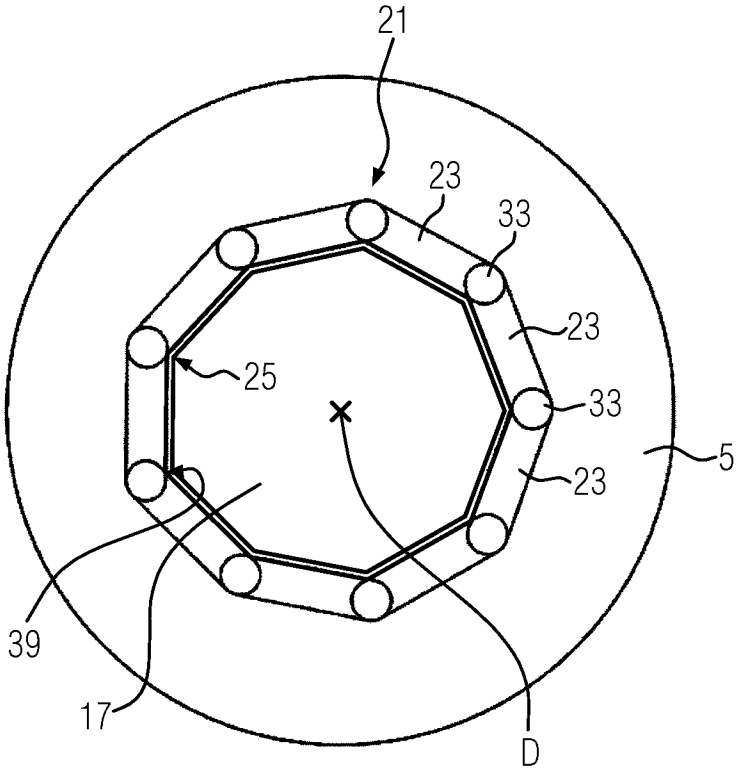
FIG. 5 is a schematic end view of another embodiment of a reception sleeve for a device for winding up a film with the reception sleeve mounted on the reception mandrel and a wound-up film thereon in accordance with the teachings of the present disclosure.

FIG. 5 shows in an analogous view to FIG. 4 an exemplary alternative embodiment of the reception mandrel 17 and the reception sleeve 21. In the illustrated embodiment, the segments 23 of the reception sleeve 21 are provided by flat panels extending in parallel to the rotation axis D of the reception mandrel 17. Neighboring segments 23 again comprise overlapping openings 33 for receiving bolts or bars 34, so that neighboring segments 23 are pivotally connected with each other. In this embodiment, an inner circumference or perimeter of the reception sleeve 21 has the shape of a polygon. The corners of the polygon form shape features 39 of the inner circumference or perimeter of the reception sleeve 21 for transmission of force between the reception mandrel 17 and the reception sleeve 21. In this embodiment, the reception mandrel 17 is provided with a corresponding polygon-shaped circumference or perimeter. The corners of said polygon-shaped circumference or perimeter form engagement structures 25 for engaging the shape features 39 of the reception sleeve 21. Thus, also in this embodiment, there is a cooperation between the reception mandrel 17 and the reception sleeve 21 ensuring co-rotation of the reception sleeve 21 with the reception mandrel 17.

Additional modifications of the shape and design of the shape features 39 of the inner circumference or perimeters of the reception sleeve 21 and of the engagement structures 25 of the reception mandrel 17 are conceivable.

Figure 6:
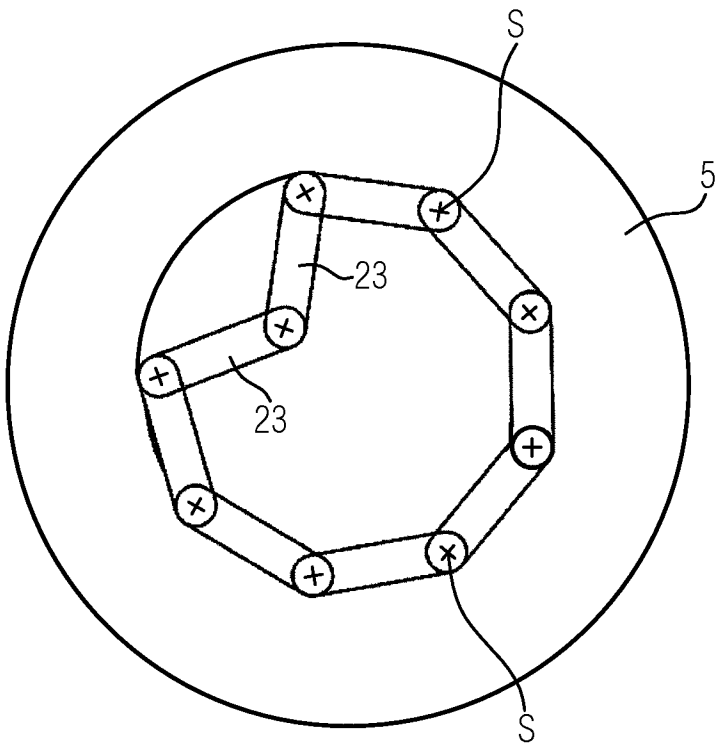
FIG. 6 is a schematic view of the device of FIG. 5 showing the reception sleeve with wound film after pulling off from the reception mandrel to show removal of the reception sleeve in accordance with the teachings of the present disclosure.

FIG. 6 illustrates the reception sleeve 21 of the embodiment from FIG. 5 after winding up the film 5 and after pulling the reception sleeve 21 with the film roll off the reception mandrel 17. As neighboring or adjacent segments 23 of the reception sleeve 21 are pivotable, the reception sleeve 21 may be brought in an instable configuration in the pulled-off state. In the instable configuration, the reception sleeve 21 can be removed from the inside of the film roll. As shown in FIG. 6, the segments 23 of the reception sleeve 21 are pivoted towards an inside towards a center axis of the reception sleeve 21. According to the same principle, it is possible to remove the reception sleeve 21 in the embodiments of FIGS. 2 to 4.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A device for winding up a film at a packaging machine, comprising:

a reception mandrel drivable for rotation about a rotation axis; and a reception sleeve for the film for being pushed onto the reception mandrel and positioned in a pushed-on state and a removed state, wherein the reception sleeve is formed by a plurality of segments arranged next to each other along a perimeter of the reception sleeve, wherein two or more adjacent segments of the plurality of segments are pivotably connected to each other;

wherein the reception mandrel is formed as rigid body having one or more engagement structures that are configured to cooperate with one or more shape features of an inner perimeter of the reception sleeve when the reception sleeve has been pushed onto the reception mandrel, so that a rotation of the reception mandrel about the rotation axis causes the reception sleeve to co-rotate.

2. The device according to claim 1, wherein in the pushed-on state of the reception sleeve, the adjacent segments of the plurality of segments of the reception sleeve are connected pivotably about pivot axes that extend in parallel with the rotation axis.

3. The device according to claim 1, wherein the one or more engagement structures extend in parallel with the rotation axis.

4. The device according to claim 1, wherein a plurality of the one or more engagement structures are symmetrically distributed along a perimeter of the reception mandrel.

5. The device according to claim 1, wherein at least four engagement structures are provided along a perimeter of the reception mandrel.

6. The device according to claim 1, wherein a number of the one or more engagement structures corresponds to a number of the plurality of segments of the reception sleeve.

7. The device according to claim 1, wherein the one or more engagement structures are provided as one of one or more projections or one or more ribs.

8. The device according to claim 1, wherein the one or more engagement structures of the reception mandrel and the shape features of the inner perimeter of the reception sleeve have shapes that correspond to each other.

9. The device according to claim 1, wherein the one or more shape features of the inner perimeter of the reception sleeve are defined by one of a mutual arrangement of the plurality of segments of the reception sleeve, or a shape of the individual segments of the reception sleeve.

10. The device according to claim 1, further comprising a retainer configured to secure an axial position of the reception sleeve on the reception mandrel.

11. The device according to claim 10, wherein the retainer comprises one of an elastic element or a wedge system.

12. The device according to claim 11, wherein the retainer comprises the elastic element and the elastic element is selected from a group consisting of an O-ring, a silicone ring, and a spring ring provided on the reception mandrel.

13. A method for winding up a film at a packaging machine, the method comprising steps of:

pushing a reception sleeve onto a reception mandrel, the reception sleeve formed by a plurality of segments arranged next to each other along a perimeter of the reception sleeve, wherein two or more adjacent segments of the plurality of segments are pivotally connected with each other;

driving the reception mandrel for rotation about a rotation axis so that the rotation of the reception mandrel about the rotation axis causes the reception sleeve to co-rotate, wherein one or more engagement structures of the reception mandrel cooperate with one or more shape features of an inner perimeter of the reception sleeve that has been pushed onto the reception mandrel; and winding a film onto the reception sleeve into a wound-up film roll.

14. The method according to claim 13, further comprising a step of securing an axial position of the reception sleeve on the reception mandrel with a retainer.

15. The method according to claim 14, wherein the retainer comprises one of an elastic element provided on the reception mandrel or a wedge system.

16. The method according to claim 14, wherein the retainer is an elastic element is one of an O-ring, a silicone ring or a spring ring.

17. The method according to claim 13, further comprising steps of:

pulling the reception sleeve and the wound-up film roll together from the reception mandrel; and changing a configuration of the reception sleeve by changing the position of one or more adjacent segments of the plurality of segments of the reception sleeve by pivoting one or more adjacent segments such that the reception sleeve can be removed from the wound-up film roll.

* * * * *